US006345474B1

(12) United States Patent
Triplett

(10) Patent No.: US 6,345,474 B1
(45) Date of Patent: Feb. 12, 2002

(54) UNIVERSAL PIER BLOCK

(76) Inventor: David Triplett, P.O. Box 113, Port Orchard, WA (US) 98366

( * ) Notice: Subject to any disclaimer, the term of this patent is extended or adjusted under 35 U.S.C. 154(b) by 0 days.

(21) Appl. No.: 09/689,290

(22) Filed: Oct. 11, 2000

Related U.S. Application Data

(60) Provisional application No. 60/159,620, filed on Oct. 14, 1999.

(51) Int. Cl.[7] ..... E02D 27/00

(52) U.S. Cl. ..... 52/169.9; 52/292; 52/126.6; 52/299; 52/263; 52/686; 52/687; 52/169.9; 405/229

(58) Field of Search ..... 52/292, 126.6, 52/299, 263, 686, 687, 169.9; 405/229

(56) References Cited

U.S. PATENT DOCUMENTS 3,653,168 A * 4/1972 Cook ..... 52/294
4,229,919 A 10/1980 Hughes ..... 52/263
5,163,967 A 11/1992 Hoffman ..... 52/299
D363,558 S 10/1995 McCoy ..... D25/113
5,561,950 A 10/1996 Collins et al. ..... 52/126.6
5,819,482 A 10/1998 Belke et al. ..... 52/126.6
5,953,874 A * 9/1999 Hoffman et al. ..... 52/299
6,141,936 A * 11/2000 Butler, Jr. ..... 52/741.1

* cited by examiner

*Primary Examiner*—Carl D. Friedman
*Assistant Examiner*—Chi Nguyen
(74) *Attorney, Agent, or Firm*—Dean A. Craine

(57) ABSTRACT

A universal block made of concrete designed to be used with different size posts and beams. The pier block is a conical, six-sided structure and includes two concentrically aligned, post-receiving voids designed to receive the ends of a (4×4) or (6×6) inch post. The (6×6) inch void is positioned above the (4×4) inch void. Formed horizontally on the top surface of the pier block are two transversely aligned beam-receiving slots. Each beam-receiving slot includes a narrow and a wide slot longitudinally aligned. The wide slot is positioned above the narrow slot. A vertically aligned drain hole is formed through the pier block from the bottom surface of the (4×4) inch void to the bottom of the pier block, which allows water to drain from the post-receiving voids.

3 Claims, 3 Drawing Sheets

UNIVERSAL PIER BLOCK

This is a utility patent application based on the provisional patent application No. (60/159,620) filed on Oct. 14, 1999.

BACKGROUND OF THE INVENTION

1. Field of the Invention

This invention relates to foundation structures, and, more particularly, to pier blocks used to support posts or beams for patio decks and the like.

2. Description of the Related Art

Wooden decks may be entirely or partially free-standing structures. Typically, some portion of the deck structure is supported by cement footings constructed in the ground. Pier blocks are often used that rise above the footings several inches to keep the ends of the posts clear of decay-causing soil. Functionally, the pier blocks carry and distribute the weight of the deck.

The posts are vertically aligned members that transmit the weight of the deck evenly to the piers and footings. Posts are commonly made of wood measuring (4×4) or (6×6) inches, depending on the structural needs of the deck.

Beams, on the other hand, are horizontally aligned members that rest on top or are bolted to the sides of the posts. The heavier the beam, the greater distance it can span. Beams are typically made of wood measuring (2×6), (2×8), (2×10), (4×4), or (4×6) inches depending on the structural needs of the deck.

Typical pier blocks are six-sided structures with a vertically aligned, square-shaped, (4×4) inch opening formed on the top surface designed to receive the lower end of a (4×4) post. Some pier blocks also include horizontally aligned slots formed on their top surface that are designed to receive a (2×6) or (2×8) inch beam placed on edge. Unfortunately, typical pier blocks cannot be used with larger posts that measure (6×6) inches, or with larger beams that measure (4×4) or (4×6) inches.

For a specific deck design, different posts and beam sizes may be used. This requires the builder to have a variety of pier blocks on hand that can be used with different size posts and beams.

What is needed is a universal pier block designed to be used with posts that measure either (4×4) or (6×6) inches, and with beams that measure (2×6) and (4×4) or (4×6) inches.

SUMMARY OF THE INVENTION

It is an object of the present invention to provide a pier block capable of supporting either a vertically aligned post or a horizontally aligned beam.

It is another object of the invention to provide such a pier block designed to be used with posts that measure either (4×4) or (6×6) inches and beams that measure either (2×6), (4×4), or (4×6) inches.

These and other objects are met by providing a universal pier block made of concrete designed to be used with different size posts and beams. The pier block is a conical, six-sided structure and includes two, concentrically aligned post-receiving voids designed to receive the ends of a (4×4) or (6×6) inch post. The (6×6) inch post-receiving void is located above the (4×4) inch post-receiving void. The clearance distances and the depth of each post-receiving void is sufficient so that a post is held substantially perpendicular to the bottom surface of the pier block when placed inside its post-receiving void.

Formed horizontally across the pier block are two traversing beam-receiving slots. The two beam-receiving slots are perpendicularly aligned to each other. Each beam-receiving slot includes an inside narrow slot and an outside wide slot longitudinally aligned with the narrow slot. The wide slot is located at the same relative elevation inside the block as the (6×6) inch post-receiving void and above the narrow slot. The narrow slot is formed at the same elevation as the (4×4) inch post-receiving void. The clearance distances and the width of the narrow slot is sufficient so that a narrow beam, i.e. a (2×6) or (2×8) inch beam, may be supported on edge when placed therein. A vertically aligned drain hole is formed between the bottom surface of the (4×4) inch post-receiving void and the bottom surface of the pier block that allows water to drain from the two post-receiving voids.

Also disclosed is an optional adjustable post-engaging bracket that fits into the drain hole. The bracket is used to adjust the position of the post relative to the pier block to accommodate settling. The bracket includes an upper U-shaped portion that fits around either a (4×4) or (6×6) inch post.

DESCRIPTION OF THE PREFERRED EMBODIMENT(S)

Figure 1:
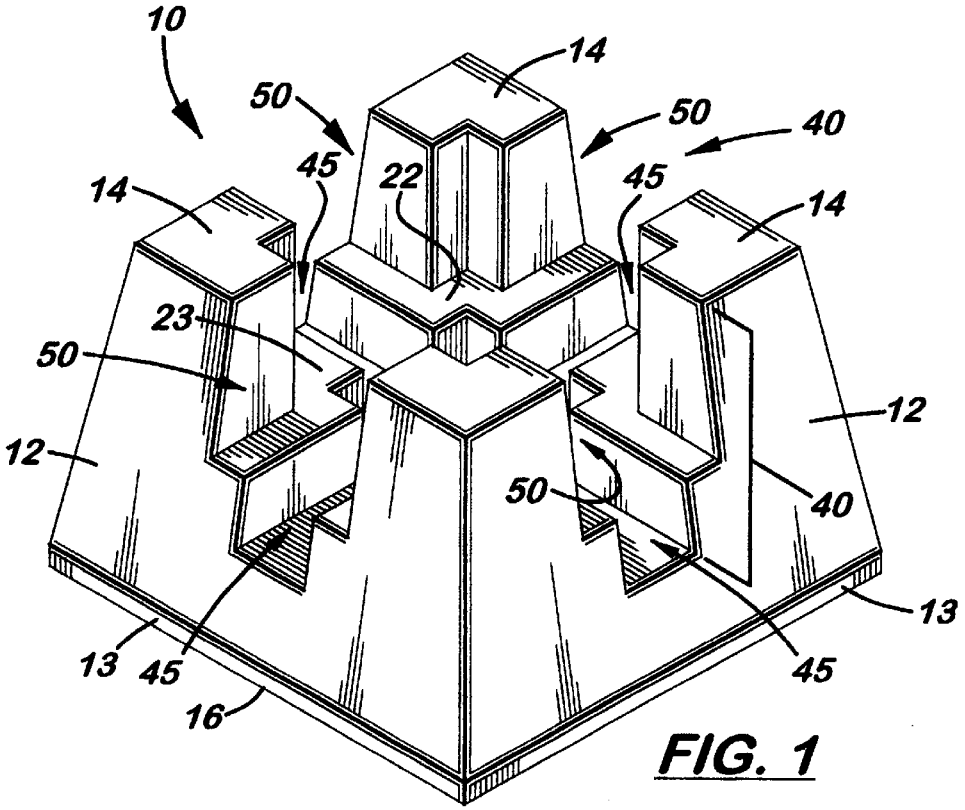
FIG. 1 is perspective view of the pier block disclosed herein.
Figure 2:
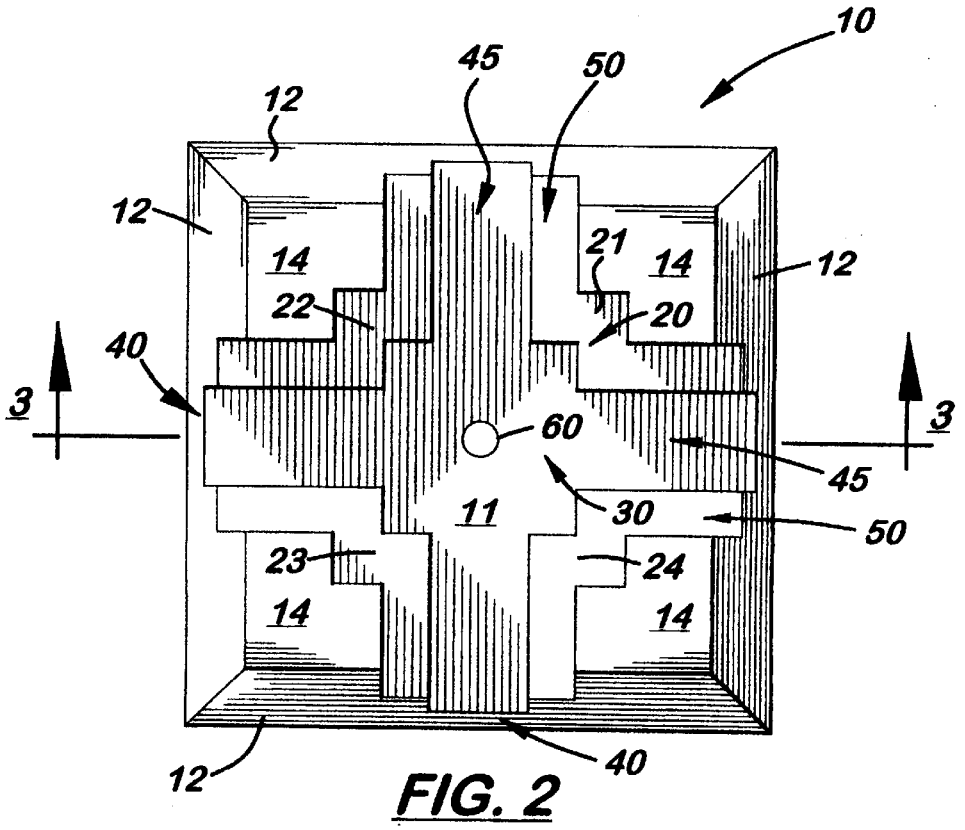
FIG. 2 is a top plan view of the pier block shown in FIG. 2.

Shown in the accompanying FIGS. 1–7, there is shown an apparatus, generally referred to as a universal pier block 10, designed to be used with different size posts 70, 70' and beams 80, 80'. The pier block 10 is a conical structure with four inward slanted sides 12, a top surface 14 and a bottom surface 16. Formed centrally on the pier block 10 are two, concentrically aligned, different size, post-receiving voids 20, 30 designed to receive the ends of a (6×6) or (4×4) inch post, respectively. The (6×6) inch post-receiving void 20 is positioned above the (4×4) inch void 30 so that the end of a (6×6) inch post 70' is supported by the four elevated corner sections 21–24 (see FIG. 2). The end of the (4×4) inch post 70' is placed into (4×4) inch void 30 and supported by the bottom surface 11 of the block 10.

Formed horizontally over the pier block 10 are two crossing beam-receiving slots 40. Each beam-receiving slot 40 includes a lower narrow slot 45 and a upper wide slot 50 longitudinally aligned and transversely positioned over the pier block 10. The relative elevation or depth of the wide slot 50 inside the pier block is approximately equal to the (6×6) inch void 20. The relative elevation or depth of the narrow slot 45 is approximately equal to the (4×4) inch void 30. A vertically aligned drain hole 60 is formed from the bottom surface 16 of the pier block 10 to the bottom surface of the post-receiving void 30 so that water may drain through.

Figure 3:
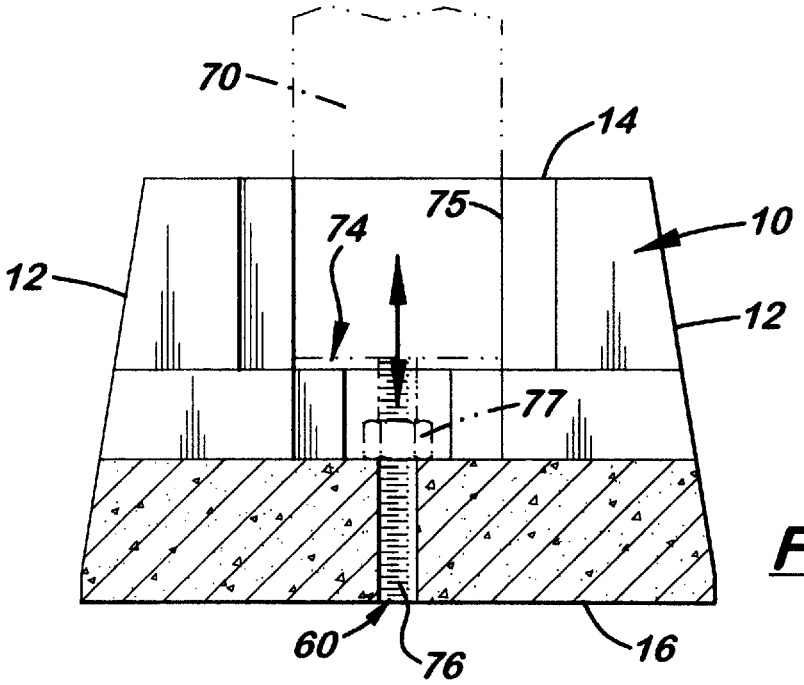
FIG. 3 is a top plan view of the invention.
Figure 4:
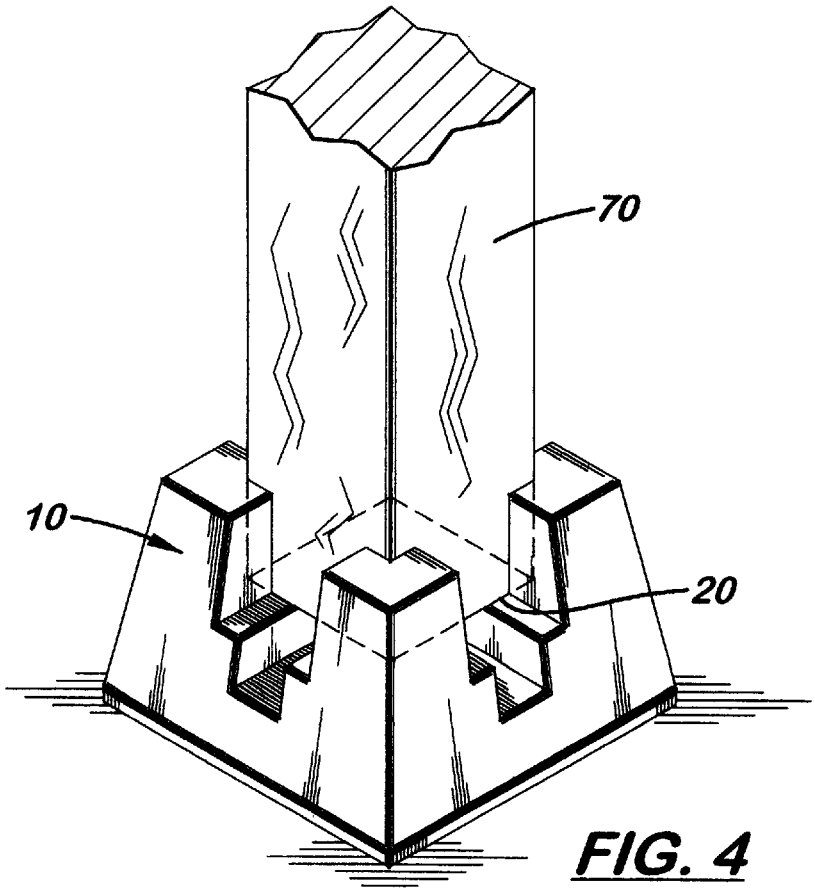
FIG. 4 is a perspective view of a 6×6 inch post attached to the pier block.
Figure 5:
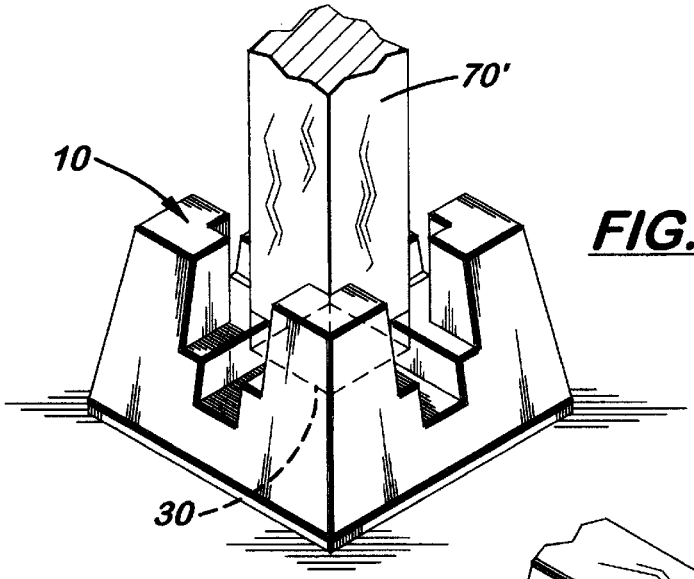
FIG. 5 is a perspective view of a 4×4 inch post attached to the pier block.
Figure 6:
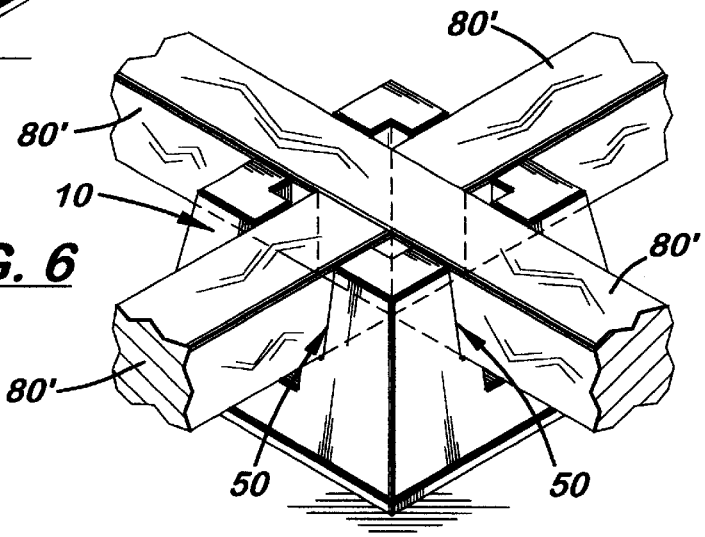
FIG. 6 is a perspective view of three 4×4 inch crossing beams supported by the pier block.
Figure 7:
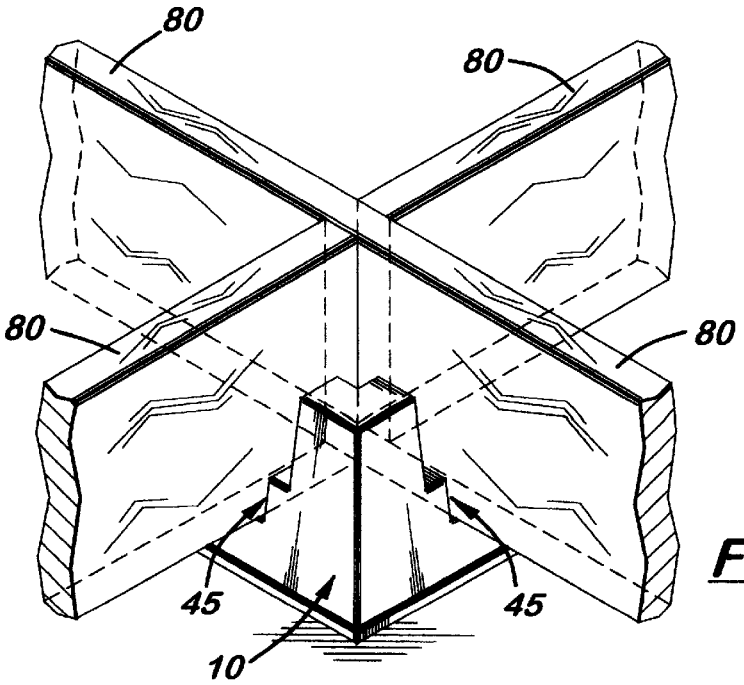
FIG. 7 is a perspective view of three 2×8 inch beams disposed on edge and supported by the pier block.

As shown in FIG. 3, an optional adjustable bracket 74 may be used to adjust the height of the post relative to the pier block. The bracket 74 includes an upper U-shaped portion 75 rigidly attached to the upper end of a threaded rod 76. A threaded nut 77 is attached to the rod 76. During use, the rod 76 is disposed inside the drain hole 60 so that the nut 77 is placed against the bottom surface 16 of the post void 20, 30. By adjusting the position of the nut 77 along the rod 76, the height of the U-shaped portion 75 may be adjusted so that the height of the post 70 is adjusted.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A pier block comprising:

a. a body having four side surfaces and parallel bottom and top surfaces;

b. two concentrically, vertically aligned, different size post-receiving voids formed on said body, the larger said post-receiving void being located above the smaller said post-receiving void;

c. two crossing, beam-receiving slots formed on said body, said beam slots including a lower narrow beam slot and an upper wide beam slot, said narrow beam slots being the same width and same elevation as said smaller void and said larger beam slots being at an elevation as said smaller void and said larger beam slots being the same width and same elevation as said larger void;

d. a vertically aligned drain hole formed on said body and communicating with said post receiving voids; and, e. a height adjustable bracket selectively placed into said drain hole for supporting a post at different elevations within said post receiving voids.

2. The pier block as recited in claim 1, wherein the larger said post-receiving void receives a (6×6) inch post.

3. The pier block as recited in claim 1, wherein the smaller said post-receiving void receives a (4×4) inch post.

* * * * *

UNITED STATES PATENT AND TRADEMARK OFFICE

CERTIFICATE OF CORRECTION

PATENT NO. : 6,345,474 B1
APPLICATION NO. : 09/689290
DATED : February 12, 2002
INVENTOR(S) : David Triplet It is certified that error appears in the above-identified patent and that said Letters Patent is hereby corrected as shown below:

In the Claims

In Claim 1, in Col 4, lines 10-12, please delete the following phrase: "at an elevation as said small void and said larger beam slots being"

Signed and Sealed this
Fifteenth Day of March, 2016

Michelle K. Lee

Michelle K. Lee
*Director of the United States Patent and Trademark Office*